United States Patent [19]

Rose et al.

[11] Patent Number: 4,591,674

[45] Date of Patent: May 27, 1986

[54] PULSE GENERATOR

[75] Inventors: Jochen Rose, Röthenbach; Manfred W. Zebisch, Georgensgmünd, both of Fed. Rep. of Germany

[73] Assignee: International Standard Electric Corporation, New York, N.Y.

[21] Appl. No.: 618,644

[22] Filed: Jun. 8, 1984

[30] Foreign Application Priority Data

Jun. 9, 1983 [DE] Fed. Rep. of Germany ..... 3320769

[51] Int. Cl.[4] ..... H01H 19/00

[52] U.S. Cl. ..... 200/11 DA; 200/11 R; 200/153 P; 200/155 R; 200/292

[58] Field of Search ..... 200/11 R, 11 A, 11 D, 200/11 DA, 11 G, 11 TW, 17 R, 18, 153 P, 155 R, 291, 292, 307, 336

[56] References Cited

U.S. PATENT DOCUMENTS

| | | | |
|---|---|---|---|
| 3,514,774 | 5/1970 | Dering | 340/347 P |
| 3,736,390 | 5/1973 | Lockard | 200/11 DA |
| 3,754,106 | 8/1973 | MacDonald | 200/11 DA X |
| 3,975,601 | 8/1976 | Whelan | 200/11 R |
| 4,037,116 | 7/1977 | Hodama | 200/11 DA X |
| 4,131,771 | 12/1978 | Erickson et al. | 200/11 DA |
| 4,145,585 | 3/1979 | Iwasaki | 200/11 DA |
| 4,163,879 | 8/1979 | Mayer et al. | 200/11 TW |
| 4,282,415 | 8/1981 | Shimuzu et al. | 200/11 G X |
| 4,392,030 | 7/1983 | Buss | 200/11 G X |
| 4,443,670 | 4/1984 | Nakamura et al. | 200/11 DA |
| 4,504,706 | 3/1985 | Watanabe et al. | 200/11 R |

FOREIGN PATENT DOCUMENTS

| | | |
|---|---|---|
| 1913370 | 6/1970 | Fed. Rep. of Germany . |
| 2853505 | 6/1980 | Fed. Rep. of Germany . |
| 3120598 | 3/1982 | Fed. Rep. of Germany . |
| 3136598 | 3/1983 | Fed. Rep. of Germany . |

*Primary Examiner*—J. R. Scott

*Attorney, Agent, or Firm*—Donald J. Lenkszus

[57] ABSTRACT

In a pulse generator with a rotor (7) provided with a conductive pattern and fixed contact springs wiping over the pattern, the latter is formed by a central continuous slip ring (15) which is concentric with the drive shaft (3) of the rotor (7) and has inwardly and outwardly projecting teeth (16; 17), the number of internal teeth (16) being equal to the number of external teeth (17), and the internal and external teeth having the same angular spacing ($\alpha$). A fixed contact (32) slides on the slip ring, and two fixed impulse contacts (33, 31) slide on circular paths (K1, K2) formed by the internal teeth (16) and the external teeth (17), respectively, and the internal teeth (16) are staggered with respect to the external teeth (17) and/or the two fixed impulse contacts (31, 33) are displaced in relation to one another such that at least in one direction of rotation of the rotor (7), the fixed impulse contacts (31, 33) cannot simultaneously make contact with a tooth (16, 17) of their circular paths (K1, K2) or with the flank of such a tooth.

18 Claims, 2 Drawing Figures

PULSE GENERATOR

BACKGROUND OF THE INVENTION

The present invention relates to an electromechanical pulse generator having a rotor with a conductive pattern thereon and fixed contact springs wiping over the pattern.

A pulse generator of this kind which is designed as a digital-output angular-displacement transducer is disclosed in German Utility Model No. 80 05 990. There, contact springs are arranged on a concentric circle. Nothing is said about the configuration of the conductive patterns. Also, the pulse generator disclosed there is an inductive angular-displacement transducer.

An electromechanical pulse generator is disclosed in DE-OS No. 31 36 598. There, a central contact spring is deflected by a toothed disk, and the contact of the same is urged against an opposite contact of a second contact spring. As a result of the relatively slow speed at which this takes place, particularly if single pulses are provided i.e., a single contact closing operation, is frequently difficult to implement.

SUMMARY OF THE INVENTION

The object of the present invention is to provide an electromechanical pulse generator which is easy to manufacture, suitable for rough usage and in which the contacts close without chatter or bounce.

A pulse generator in accordance with the invention is of the type having a rotor provided with a conductive pattern and fixed contact springs wiping over the pattern. The conductive pattern, in accordance with the invention, is formed by a central continuous slip ring which is concentric with the drive shaft of the rotor and has inwardly and outwardly projecting teeth. The number of internal teeth is equal to the number of external teeth. The internal and external teeth have the same angular spacing. A fixed contact slides on the slip ring, and two fixed impulse contacts slide on circular paths formed by the internal teeth and the external teeth, respectively. The internal teeth are staggered with respect to the external teeth and/or the two fixed impulse contacts are displaced in relation to one another such that at least in one direction of rotation of the rotor, the fixed impulse contacts cannot both simultaneously make contact with a tooth of their circular paths or with the flank of such a tooth.

BRIEF DESCRIPTION OF THE DRAWINGS

The invention will now be described with the aid of the embodiment illustrated in the accompanying drawings, in which.

DETAILED DESCRIPTION

Figure 1:
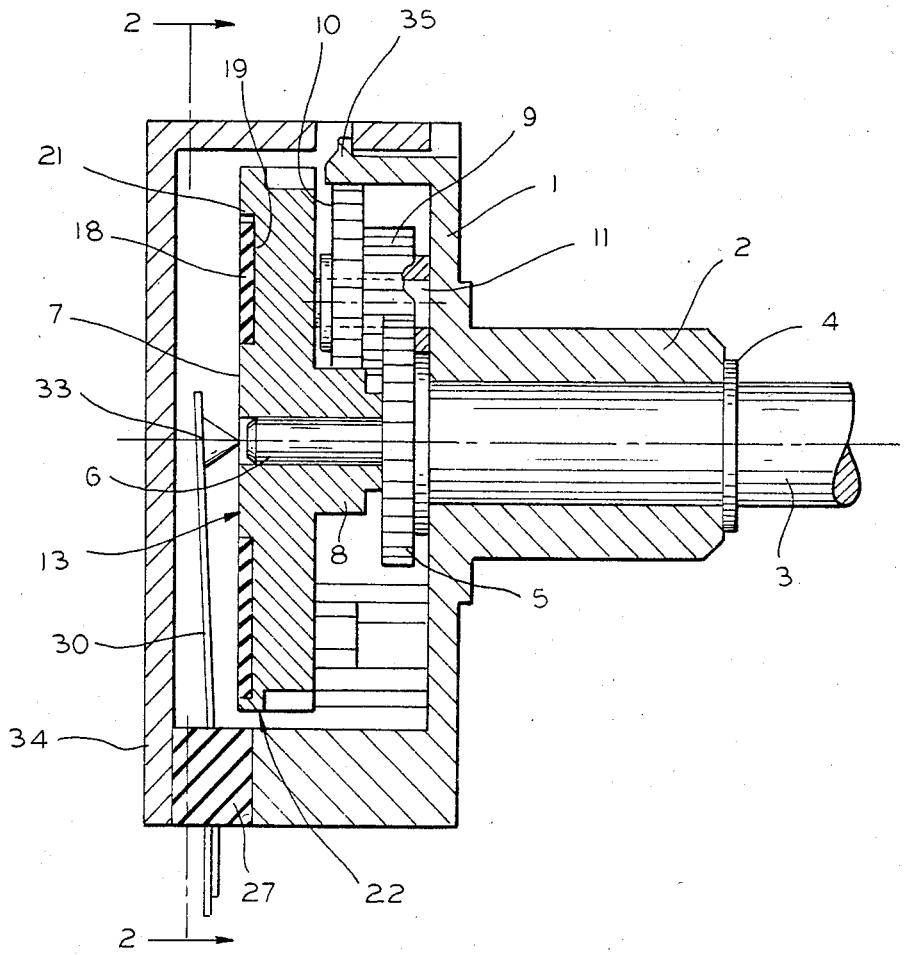
FIG. 1 is a sectional side view of a pulse generator in accordance with the invention.
Figure 2:
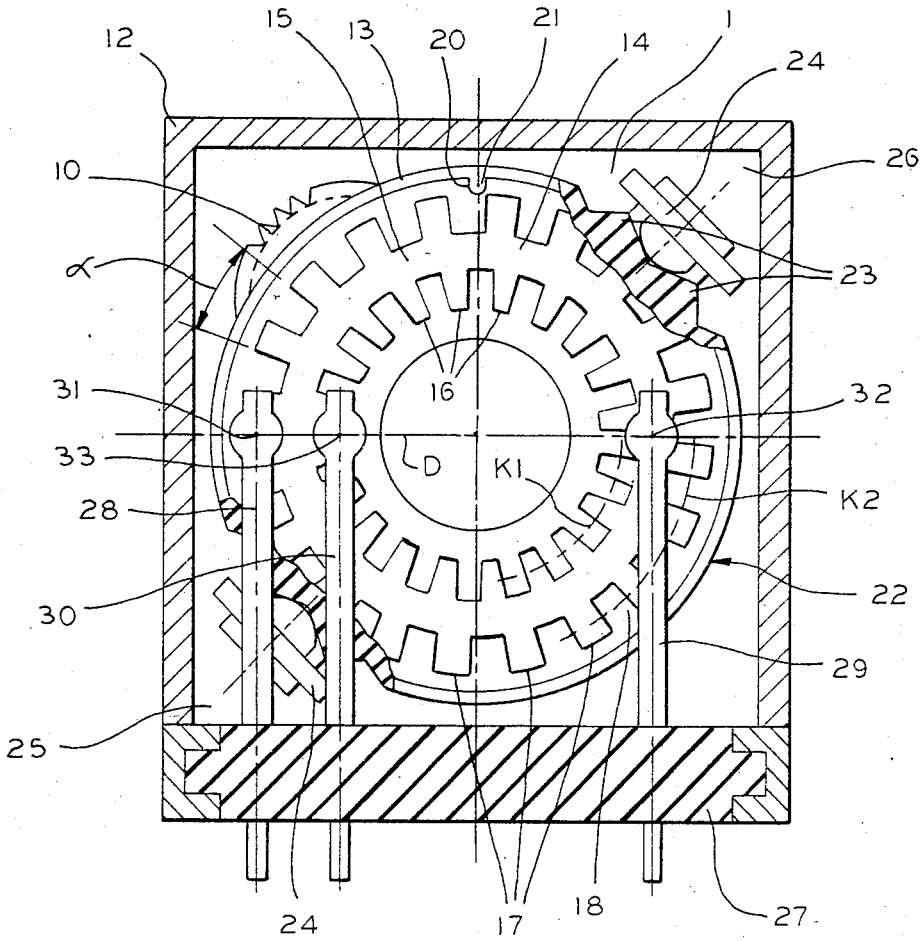
FIG. 2 is a section taken along Line 2—2 of FIG. 1.

The reference numeral 1 designates a cup-shaped part of a housing with a bearing bushing 2 molded or attached thereto. Pivotally mounted in the latter is a drive shaft 3, which is prevented from sliding by a retaining ring 4. In part 1 of the housing, the drive shaft 3 is provided with a driving pinion 5 and an inwardly projecting pivot journal 6.

A rotor 7 has been slipped over and is pivoted on the pivot journal 6. The side of the rotor 7 facing the driving pinion 5 is provided with, or rigidly coupled to, a pinion 8. The driving pinion 5 and the pinion 8 are operatively connected via a rigidly coupled pair of spur gears 9, 10, which is preferably of one-piece construction. The pair of gears 9, 10 is pivoted on a shaft 11 which is moulded or attached to the part 1 of the housing. The spur gear 9 is smaller than the driving pinion 5, and the spur gear 10 is larger than the pinion 8. Advantageously, cup shaped part 1 is rectangular or square, and the shaft 11 is located in the direction of a corner 12.

The surface 13 of the rotor 7 is provided with a conductive layer 14 forming a continuous slip ring 15 which is concentric with the drive shaft 3. Conductive layer 14 has inwardly projecting, rectangular or trapezoidal teeth 16, which are arranged on a likewise concentric circular path K1, and outwardly projecting, rectangular or trapezoidal teeth 17, which are arranged on an outer circular path K2.

The conductive layer 14 can be deposited directly on the rotor 7 or, as in the embodiment, formed on a special, thin insulating disk 18 in the manner of a printed circuit, for example. This insulating disk 18 lies in a flat depression 19 in the surface 13 of the rotor 7. A projection 21 on the rotor 7 engages a recess 20 in the insulating disk 18, to prevent disk 18 from rotating relative to rotor 7.

The number of internal teeth 16 and their angular spacing $\alpha$ is equal to the number and angular spacing $\alpha$ of the external teeth 17. Locking cams 23 are formed on the rotor 7, preferably along the circumference 22 thereof. The locking cams 23 are equal in number to the number of internal teeth 17 and have the same angular spacing $\alpha$. The locking cams 23 coact with detents 24. Detents 24 are preferably moulded to the part 1 of the housing, advantageously extend in the direction of the drive shaft 3, and are resiliently deflectable, preferably in a direction perpendicular to the drive shaft 3. The detents 24 are located in the diametrically opposed corners 25 and 26, so that the forces acting on the drive shaft 3 and the rotor 7 cancel each other.

Inserted in a lower part 27 of the housing wall, or held by the moulded material of the lower part, are preloaded contact springs 28, 29, 30, which press on the surface 13 of the rotor 7. The contact spring 28 is associated with the external teeth 17, the contact spring 29 with the slip ring 15, and the contact spring 30 with the internal teeth 16. Advantageously, the contact springs 28, 29,30, to which fixed contacts are fastened, are arranged approximately perpendicular to the diameter of the rotor 7, and their contact points 31, 32, 33 preferably lie at least approximately on a straight line, particularly on or near the line D through the center of the rotor. The contact point 32 acts as a sliding type of fixed contact, and each of the contact points 31 and 33 acts as a fixed impulse contact.

The contact points 31 and 33 and the locking cams 23 are arranged so that, when detents 24 engage the two locking cams 23, the contact points 31 and 33 will not be in contact with any of the teeth 17 and 16, respectively.

The teeth 16 or their flanks on one side are shifted in phase with respect to the teeth 17 or their flanks on the same side by an angle between 0° and 180°, to that the direction of rotation of the rotor 7 can be derived from the phase shift in a manner known per se. Instead of staggering the teeth 16, 17 or their flanks with respect to each other, the contact springs 28 and 30 may be so disposed that the contact points 31 and 33 cause this phase shift, or both the teeth 16, 17 or their flanks and the contact points 31, 33 may be so displaced in relation to one another that the resulting pulses differ in phase by 0° and 180°. The displacement of the pulse edges may also be brought about by using a width of the teeth 16 different from that of the teeth 17. What is important is that in one direction of rotation of the rotor 7, one tooth 16 or 17 is contacted earlier than the other tooth 17 or 16, respectively.

The cup-shaped part 1 of the housing may be closed by a further, likewise cup-shaped part 34, and the two parts may be interlocked in the closed condition by a locking member 35 at the part 1 and/or at the part 34. The part 27 of the housing wall, which supports the contact springs 28,29,30, may be designed as a strip capable of being inserted between the two parts 31 and 34 of the housing. This facilitates the adjustment or preloading of the contact springs 28,29,30.

We claim:

1. A pulse generator comprising a drive shaft;

a rotor carried on said drive shaft and having a conductive pattern concentric with said drive shaft, said conductive pattern having a central continuous slip ring having a plurality of radially inward extending first teeth and a plurality of radially outward extending second teeth, said first teeth being spaced apart by a predetermined angular spacing, said second teeth being spaced apart by said predetermined angular spacing;

a fixed contact in continuous sliding engagement with said continuous slip ring;

a first fixed impulse contact positioned so as to slidingly engage and disengage said first teeth as said rotor rotates;

a second fixed impulse contact positioned so as to slidingly engage and disengage said second teeth as said rotor rotates;

said plurality of first teeth being staggered with respect to said plurality of second teeth, said first and second fixed impulse contacts being displaced relative to each other such that in both directions of rotation of said rotor said first fixed impulse contact does not engage one of said plurality of first teeth simultaneous with said second fixed impulse contact engaging one of said plurality of second teeth.

2. A pulse generator in accordance with claim 1 wherein:

each of said fixed contact and said first and second fixed impulse contacts includes a contact element for respectively engaging said continuous slip ring, said plurality of first teeth and said plurality of second teeth;

said contact elements of said fixed contact, said first and second fixed impulse contacts lying on an imaginary line extending through the center of said rotor shaft;

and at least the flanks on one side of each of said plurality of first teeth being staggered with respect to the flanks on one side of each of said plurality of second teeth.

3. A pulse generator in accordance with claim 2 wherein:

said rotor comprises a plurality of locking cams equal in number to said plurality of first teeth, said plurality of locking cams being spaced apart by said predetermined angular spacing;

said pulse generator comprises at least one detent coacting with said plurality of locking cams to hold said rotor in predetermined positions wherein neither said first nor said second fixed impulse contacts simultaneously engages one of said plurality of first teeth or one of said plurality of second teeth respectively.

4. A pulse generator in accordance with claim 3 wherein:

said at least one detent is positioned parallel to said drive shaft and is resiliently deflectable in a direction perpendicular to said drive shaft.

5. A pulse generator in accordance with claim 1 wherein:

said rotor comprises a plurality of locking cams equal in number to said plurality of first teeth, said plurality of locking cams being spaced apart by said predetermined angular spacing;

said pulse generator comprises at least one detent means for coacting with said plurality of locking cams to hold said rotor in predetermined positions wherein neither said first nor said second fixed impulse contact engages one of said plurality of first teeth or one of said plurality of second teeth, respectively.

6. A pulse generator in accordance with claim 5 wherein:

said plurality of locking cams are disposed along the circumference of said rotor.

7. A pulse generator in accordance with claim 6 wherein:

said at least one detent is positioned parallel to said drive shaft and is resiliently deflectable in a direction perpendicular to said drive shaft.

8. A pulse generator in accordance with claim 5 wherein:

said at least one detent is positioned parallel to said drive shaft and is resiliently deflectable in a direction perpendicular to said drive shaft.

9. A pulse generator in accordance with claim 8 comprising:

a housing containing said rotor; and wherein said at least one detent is carried on said housing.

10. A pulse generator in accordance with claim 9 wherein:

said plurality of locking cams are disposed along the circumference of said rotor.

11. A pulse generator in accordance with claim 10 wherein:

said at least one detent is positioned parallel to said drive shaft and is resiliently deflectable in a direction perpendicular to said drive shaft.

12. A pulse generator in accordance with claim 1 comprising:

a transmission coupling drive shaft to said rotor.

13. A pulse generator in accordance with claim 12 comprising:

a housing containing said rotor and said transmission.

14. A pulse generator in accordance with claim 12 wherein:

said transmission comprises a driving pinion rigidly coupled to said drive shaft and a coupled pair of spur gears, one of said spur gears engaging said driving pinion;

said drive shaft comprises a pivot journal; and said rotor is rigidly coupled to a pinion which is pivoted on said pivot journal, the other of said spur gears engaging said pinion.

15. A pulse generator in accordance with claim 13 wherein:

said transmission comprises a driving pinion rigidly coupled to said drive shaft and a coupled pair of spur gears, one of said spur gears engaging said driving pinion;

said drive shaft comprises a pivot journal; and said rotor is rigidly coupled to a pinion which is pivoted on said pivot journal, the other of said spur gears engaging said pinion.

16. A pulse generator in accordance with claim 15 comprising a shaft supported in said housing; and wherein said coupled pair of spur gears are pivoted on said shaft.

17. A pulse generator in accordance with claim 1 comprising:

a housing containing said rotor; and wherein said fixed contact and said first and second fixed impulse contacts are supported in a wall portion of said housing.

18. A pulse generator in accordance with claim 17 wherein said housing comprises first and second parts, said wall portion comprising a strip insertable between said first and second parts.

* * * * *